United States Patent [19]

Wisotsky

[11] Patent Number: 4,505,829

[45] Date of Patent: Mar. 19, 1985

[54] LUBRICATING OIL COMPOSITION CONTAINING SEDIMENT-REDUCING ADDITIVE

[75] Inventor: Max J. Wisotsky, Highland Park, N.J.

[73] Assignee: Exxon Research & Engineering Co., Florham, N.J.

[21] Appl. No.: 316,142

[22] Filed: Oct. 29, 1981

Related U.S. Application Data

[63] Continuation of Ser. No. 147,707, May 8, 1980, abandoned.

[51] Int. Cl.[3] ..... C10M 1/48

[52] U.S. Cl. ..... 252/32.7 E; 252/33.4; 252/42.7; 252/56 R

[58] Field of Search ..... 252/32.7 E, 33.4, 42.7, 252/49.6, 52 A, 56 R, 51.5 A

[56] References Cited

U.S. PATENT DOCUMENTS

| | | | |
|---|---|---|---|
| 3,172,892 | 3/1965 | LeSuer et al. | 252/51.5 A X |
| 3,235,499 | 2/1966 | Waldmann | 252/56 R X |
| 3,254,025 | 5/1966 | LeSuer | 252/32.7 E |
| 3,344,069 | 9/1967 | Stuebe | 252/49.6 |
| 3,626,559 | 12/1971 | Rossmann et al. | 252/52 R X |
| 3,679,585 | 7/1972 | Brook et al. | 252/51.5 A |
| 3,920,562 | 11/1975 | Foehr | 252/32.7 E |
| 3,933,659 | 1/1976 | Lyle et al. | 252/32.7 E |
| 4,105,571 | 8/1978 | Shaub et al. | 252/32.7 E |

*Primary Examiner*—Andrew Metz

*Attorney, Agent, or Firm*—John J. Mahon

[57] ABSTRACT

Lubricating oil compositions which contain polycarboxylic acid-glycol esters as friction modifiers in combination with hydrocarbon soluble alkenyl succinimide dispersants with reduced tendency toward formation of sediment upon storage through addition of small proportions of polyol or polyol anhydride partial ester of a fatty acid or an ethoxylated fatty acid, amine or amide stabilizer. Glycerol oleates are preferred stabilizer additive.

12 Claims, No Drawings

LUBRICATING OIL COMPOSITION CONTAINING SEDIMENT-REDUCING ADDITIVE

This is a continuation of application Ser. No. 147,707, filed May 8, 1980 and now abandoned.

This invention relates to storage stable lubricating oil compositions containing an additive package which provides both dispersant and friction modification properties. More particularly, this invention relates to a formulated lubricating oil composition containing a polycarboxylic acid-glycol ester friction modifier and an alkenyl succinimide dispersant having a reduced tendency to form sediment upon storage.

Lubricating oil compositions which contain polycarboxylic acid-glycol esters as friction reducing components are known in the art and are disclosed, for example, in U.S. Pat. No. 4,105,571 issued Aug. 8, 1978 to Shaub et al. The oil-soluble alkenyl succinimide dispersants, particularly polyisobutenyl succinimide dispersants, are well-known and are disclosed in U.S. Pat. No. 3,172,892, issued Mar. 9, 1965 to Le Suer et al., and U.S. Pat. No. 3,933,659, issued Jan. 20, 1976 to Lyle et al.

It is known that lubricating oil compositions containing the aforesaid alkenyl succinimide dispersants and polycarboxylic acid-glycol ester friction modifiers offer a number of advantageous properties, however, a problem frequently encountered is the tendency of appreciable quantities of sediment to form upon storage of formulated compositions containing these additives and other conventionally employed additives, especially metal containing additives. The present invention deals with this problem by providing additives found effective in stabilizing such compositions against sediment formation, the stabilizer additives being certain polyol-fatty acid esters or ethoxylated fatty acids, amines or amides.

Shaub et al in U.S. Pat. No. 4,105,571 disclose that incompatibility problems of zinc dihydrocarbyl dithiophosphate and glycol ester friction-reducing components can be resolved by pre-dispersing either component in an ashless dispersant prior to combining them in the lubricating oil formulation; however, Shaub et al do note that formulations containing dispersants based on a reaction product of polyisobutenyl succinic anhydride and polyamine exhibited evidence of storage instability and suggested that an increased amount of dispersant may be necessary to maintain compatibility. The present invention deals with this problem by providing a stabilizer additive found effective in compatibilizing the compositions disclosed herein or enhancing the compatibility of said components.

In accordance with the present invention, there are provided storage stable lubricating oil compositions having a reduced tendency to form sediment comprising:

(a) a polycarboxylic acid-glycol ester friction reducing component, (b) an oil-soluble alkenyl succinimide or borated alkenyl succinimide dispersant, and (c) an oil-soluble stabilizer additive being a polyol or polyol anhydride partial ester of a $C_8$–$C_{22}$ fatty acid or an ethoxylated fatty acid, fatty amine or fatty amide, in an amount effective to reduce the tendency of said lubricating oil formulation to form sediment.

The term lubricating oil composition as used herein is meant to refer to fully formulated compositions intended for use, for example as crankcase motor oils which contain a number of conventionally used additives in the usual amounts especially oxidation inhibitors, rust inhibitors, viscosity index improvers, such as, olefin copolymers, pour depressants, oil-soluble detergent additives such as the neutral and basic metal phenates, sulfurized phenates and sulfonates, such as the calcium and magnesium sulfurized phenates and sulfonates, as well as the zinc dialkyl dithiophosphates which are useful anti-oxidant and anti-wear additives. It is believed that the metal containing additives such as the normal and basic metal sulfonates, phenates and sulfurized phenates and metal dithiophosphates contribute to the tendency of lubricating oil compositions to form sediment when in the presence of the ester friction reducing components and alkenyl succinimide dispersant. The metal phenates and sulfonates noted above are typically employed in amounts of from about 2 to 5 weight percent and metal dithiophosphates are usually found in fully formulated lubricating oil compositions in amounts from about 1 to 3 weight percent.

The friction reducing esters are generally derived from the esterification of a polycarboxylic acid with a glycol and may be partial esters or diesters of the formulas:

HO—R′—OOC—R—COOH and

HO—R′—OOC—R—COOR″—OH wherein R is the hydrocarbon radical of the acid and R′ and R″ is either the hydrocarbon radical or an alkane diol or the oxy-alkylene radical from an oxa-alkane diol as defined hereinbelow. The polycarboxylic acid may be an aliphatic saturated or unsaturated acid and will generally have a total of about 24 to 90, preferably about 24 to 60, carbon atoms and about 2 to 3, preferably about 2, carboxylic acid groups with at least about 9 carbon atoms, preferably about 12 to 42, especially 16 to 22 carbon atoms between the carboxylic acid groups. Generally about 1–3 moles of glycol, preferably 1–2 moles of glycol, are used per mole of acid to provide either a complete or partial ester.

Also, esters can be obtained by esterifying a dicarboxylic acid or mixture of such acids with a diol or mixture of diols, in which case R would then be the hydrocarbon radical of the dicarboxylic acid and R′ and R″ would be the hydrocarbon radicals associated with the diol or diols.

The friction reducing esters are typically used in amounts ranging from about 0.01 percent to 2 percent by weight, more preferably 0.05 to 0.5 percent by weight based upon the overall weight of the lubricating oil composition, more preferably, formulations containing 0.1 to 0.3 weight percent are highly effective.

Especially preferred are the dimer acid ester friction reducing esters. The term dimer acid used herein is meant to refer to those substituted cyclohexene dicarboxylic acids formed by a Diels-Alder-type reaction which is a thermal condensation of $C_{18}$–$C_{22}$ unsaturated fatty acids, such as tall oil fatty acids, which typically contain about 85 to 90 percent oleic or linoleic acids. Such dimer acids typically contain about 36 carbon atoms. The dimer acid structure can be generalized as follows:

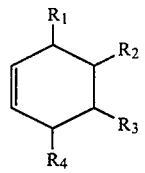

with two of the R groups being carboxyl groups and two being hydrocarbon groups depending upon how the condensation of the carboxylic acid has occurred. The carboxyl groups can be $—(CH_2)_8COOH$; $—CH{=}CH(CH_2)_8COOH$; $—(CH_2)_7COOH$; $—CH_2CH{=}CH(CH_2)_7COOH$; $—CH{=}CH(CH_2)_7COOH$ and the hydrocarbon terminating group can be represented by: $CH_3(CH_2)_4—$; $CH_3(CH_2)_5—$; $CH_3(CH_2)_7—$; $CH_3(CH_2)_4CH{=}CH—$; $CH_3(CH_2)_4CH{=}CH\ CH_2—$; and the like. The dimer of linoleic acid which is the preferred embodiment can be expressed in the following formula:

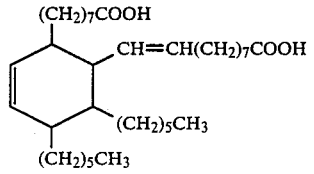

Also the term dimer acid as used herein necessarily includes products containing up to about 24 percent by weight trimer, but more typically about 10 percent by weight trimer since, as is well known in the art, the dimerization reaction provides a product containing a trimer acid having molecular weight of about three times the molecular weight to the starting fatty acid.

The polycarboxylic acids or dimer acids noted above are esterified with a glycol, the glycol being an alkane diol or oxa-alkane diol represented by the formula $HO(RCHCH_2O)_xH$ wherein R is H or $CH_3$ and x is about 2 to 100, preferably 2 to 25 with ethylene glycol and diethylene glycol particularly preferred. A preferred embodiment is formation of the ester with about 1 to 2 moles of glycol per mole of dimer acid or polycarboxylic acid, such as the ester of diethylene glycol with dimerized linoleic acid.

The oil-soluble alkenyl succinimide ashless dispersants are those formed by reacting a polyalkenyl succinic acid or anhydride with a polyalkyleneamine. Preferably the alkenyl group is derived from a polymer of a $C_2$ to $C_5$ mono-olefin, especially a polyisobutylene where the polyisobutenyl group has a number average molecular weight of about 700 to about 5,000, more preferably about 900 to 1,500. The polyamines may be represented by the formula $NH_2(CH_2)_n—(NH(CH_2)_n)_m—NH_2$ wherein n is 2 to 3 and m is 0 to 10. Illustrative are ethylene diamine, diethylene triamine, triethylene tetramine, tetraethylene pentamine, which is preferred, pentaethylene hexamine and the like, as well as mixtures of such polyamines. These amines are reacted with the alkenyl succinic acid or anhydride in ratios of about 1:1 to 10:1 moles of alkenyl succinic acid or anhydride to polyamine.

The borated alkenyl succinimide dispersants are also well known in the art as disclosed in U.S. Pat. No. 3,254,025. These borated derivatives are provided by treating the alkenyl succinimide with a boron compound selected from the class consisting of boron oxides, boron halides, boron acids and esters thereof in an amount to provide from about 0.1 atomic proportion of boron to about 10 atomic proportions of boron for each atomic proportion of nitrogen in the dispersant. The borated product will generally contain about 0.1 to 2.0, preferably 0.2 to 0.8 weight percent boron based upon the total weight of the borated dispersant. The boron is considered to be present as dehydrated boric acid polymers attaching as the metaborate salt of the imide. The boration reaction is readily carried out by adding from about 1 to 3 weight percent, based on the weight of dispersant, of said boron compound, preferably boric acid, to the dispersant as a slurry in mineral oil and heating with stirring as from about 135° C. to 165° C. for from 1 to 5 hours followed by nitrogen stripping and filtration of the product.

These alkenyl succinimide ashless dispersants and borated derivatives thereof are used customarily in lubricating oil compositions in amounts ranging from 0.1 to 10 percent, preferably 0.5 to 5 percent, by weight based upon the total weight of the finished composition.

One category of the stabilizer additives of the present invention may generally be defined as the polyol ester of a $C_8$–$C_{22}$ fatty acid, partial ester meaning at least one hydroxy group remains unreacted. Preferably 1 to 3 free OH groups are present such as an average of 1.5 to 2.5 free hydroxy groups. Such compounds are, per se, known in the art and it is only their use as a stabilizing agent in a formulated composition containing both the ester friction modifier and alkenyl succinimide dispersant or borated dispersant derivative thereof which is the basis of the present invention.

Suitable polyols for preparing the ester stabilizer of the present invention are those polyhydric alcohols such as glycerol, diglycerol, and the sugar alcohols, which may be represented in the formula $CH_2OH(CHOH)_mCH_2OH$ where m is one to five as well as the polyol anhydrides thereof. Preferred are the esters of glycerol itself, $C_3H_5(OH)_3$, sorbitol and sorbitol anhydride (sorbitan). Esters based upon relatively higher, i.e., $C_{12}$–$C_{22}$, fatty acids or mixtures of fatty acids are more preferable, such as, the tall oil fatty acids. The fatty acids may be saturated or unsaturated. Especially preferred are glycerol and sorbitan partial esters of liquid $C_{18}$–$C_{22}$ unsaturated fatty acids such as oleic, linoleic, and palmitoleic fatty acids and mixtures of such acids.

Ethoxylated oil-soluble fatty acids, fatty acid amines, and amides have also been found suitable for use as sediment-reducing stabilizer additives in the compositions of the present invention. Useful products are those oil-soluble ethoxylated additives of about $C_8$ to $C_{22}$ saturated or unsaturated fatty acids, amines or amides. The degree of ethoxylation of such products is about 2 to 30 moles, preferably 1 to 5 moles of ethylene oxide per mole of fatty acid, amine or amide, so that the products retain oil solubility. Derivatives of liquid unsaturated $C_{12}$–$C_{22}$ fatty acids are preferred, such as oleic, linoleic, palmitoleic and mixtures thereof, such as the tall oil fatty acids and vegetable oil fatty acids, for example, those derived from cottonseed and soybean oils which contain major amounts of unsaturated $C_{18}$ fatty acids and which are generally liquid at room temperature.

Of this category, the oil-soluble ethoxylated fatty acid amines are a preferred embodiment including both fatty acid monoamines and diamines, such as, oil-soluble polyethoxylated (1–3 moles of ethylene oxide) cocoamine derived from mixed coconut oil fatty acids ($C_{12}$–$C_{15}$) and tallow diamine ethoxylates (1–3 moles of ethylene oxide) derived from mixtures of predominantly $C_{16}$–$C_{18}$ fatty acids.

The quantity of sediment-reducing amount of additive stabilizer of the present invention which is used in a lubricating oil formulation is best expressed relative to the amount of the ester friction-reducing additive which is present. The broad ratio is about 2 to 20 parts by weight of additive stabilizer per part by weight of ester friction-reducing additive with the preferred ratio being about 2 to 12 parts by weight of stabilizer additive per part by weight of friction reducing ester.

While the method of addition of the stabilizer additive is largely a function of the exact composition of the total finished formulation, it is generally preferable to provide a blend of stabilizer additive, friction-reducing ester and dispersant by admixing same at moderately elevated temperatures, not greater than 150° F., and incorporating this blend into the lubricating oil formulation either prior to or subsequent to the addition of other additives in accordance with blending techniques known in the art.

The lubricating oil base stock employed herein are those customarily used. The term lubricating oil includes not only the petroleum hydrocarbon paraffinic, naphthenic, and aromatic oils of lubricating viscosity, but also synthetic oils, such as, polyethylene oils, esters of dicarboxylic acids, complex ester oils, polyglycol, and alcohol alkyl esters of carbonic or phosphoric acids, polysilicones, fluorohydrocarbon oils and the like. Preferred base stocks are mineral hydrocarbon oils of a paraffinic nature, especially those having a viscosity of about 20 to 100 cS min. (100° F.) and blends of such mineral paraffinic oils.

The stabilizer additives of the present invention are generally effective in substantially eliminating all but traces of sediment when the lubricating oil formulation contains the usually preferred amounts of friction reducing ester component, that is, about 0.05 to 0.3 weight percent and therefore, formulations prepared in accordance with the present invention which contain these amounts of friction-reducing ester component are particularly preferred. For formulations containing more than about 0.3 weight percent of ester component, there will be in most cases a substantial reduction in the amount of sediment observed after centrifuging as opposed to a complete elimination to trace levels.

EXAMPLES 1–4

Lubricating oil formulations were prepared containing the dimer acid ester friction modifier and the alkenyl succinimide dispersant to which were added the sediment-reducing additives of the present invention. The formulation was a standard 10W-SAE quality automotive lubricating oil composition containing a zinc dialkyl dithiophosphate, overbased metal sulfonate, rust inhibitor, and VI improver in typical proportions. At this point the formulation was storage stable with no evidence of sediment formation. To this was added 0.1 percent by weight of a friction modifier being the ester of a dimerized linoleic acid and diethylene glycol and 5 weight percent of the reaction product of 2.1 moles polyisobutenyl ($\overline{M}n=1300$) succinic anhydride (Sap. No. 103) and 1 mole of alkylene polyamine to provide the Base Formulation. The polyamine had a composition approximating tetraethylene pentamine and is available under the trade name "DOW E-100" from Dow Chemical Company, Midland, Mich. Samples (100 ml., calibrated test tube) of this base formulation were centrifuged for 8, 16 and 24 hours at 1900 r.p.m. at room temperature and thereafter, samples containing the sediment reducing additives of this invention were also tested for compatibility by centrifuging under the same conditions. The volume percent sediment was measured on the basis of the sediment observed in a calibrated test tube which contained the 100 ml. samples and the results are set forth in the following Table I.

TABLE I

| | Vol. % After Centrifuging | | |
|---|---|---|---|
| | 8 hrs. | 16 hrs. | 24 hrs. |
| Base | .20 | .50 | 3.00 |
| Base + Glyceride (Example 1 and 1A) | Trace | Trace | Trace |
| Base + Sorbitan Ester (Example 2) | Trace | Trace | Trace |
| Base + Ethoxylated Cocoamine (Example 3) | — | — | Trace |
| Base + Ethoxylated Tallow Diamine (Example 4) | — | — | Trace |

EXAMPLE 1

0.26 weight percent liquid mixture of mono- and diglyceride of oleic acid, 55 percent monoester, 130 cps. viscosity at 25° C., sold as ATMOS® 300 by ICI America, Inc.

EXAMPLE 1A

Example 1 was repeated using 0.56 weight percent of the same glyceride with the same results after centrifuging.

EXAMPLE 2

1.25 weight percent Sorbitan Monooleate liquid having 1900 cps. at 25° C. viscosity sold as Arlacel® 80 by ICI America, Inc.

EXAMPLE 3

1.25 weight percent ethoxylated cocoamine sold as Ethomeen® C-12 by Armak, Inc., 2 moles ethylene oxide per mole, average mol. weight=285.

EXAMPLE 4

1.25 weight percent ethoxylated tallow diamine sold as Ethoduomeen® TD-13 by Armak, Inc., 3 moles ethylene oxide per mole, average mol. weight=530.

EXAMPLE 5

A formulation was prepared similar to the base formulation, the preceding Examples except that 0.3 weight percent of the dimer acid ester friction reducing component was used. The base formulation showed about a 3.0 vol. percent sediment formation after 24 hours centrifuging. After addition of 1.25 weight percent of the same glyceride of Example 1, the formation was stable after 24 hours centrifuging.

EXAMPLE 6

Example 5 was repeated with the same results using the same stabilizer additive in the same amount except that the base formulation contained a borated alkenyl succinimide dispersant prepared by reacting the dispersant of the base formulation with a slurry of 1.4 moles of boric acid in mineral oil over a 3 hour period at 135° to 165° C. followed 4 hours of nitrogen stripping. The final product contained 1.5 weight percent nitrogen and 0.3 weight percent boron and had a $\overline{M}n$ of about 3,000.

What is claimed is:

1. A storage stable lubricating oil composition having a reduced tendency to form sediment comprising a lubricating oil containing:

(a) 0.01 to 2 percent by weight of a polycarboxylic acid-glycol ester friction reducing component;

(b) 0.1 to 10 percent by weight of an oil-soluble alkenyl succinimide or borated alkenyl succinimide dispersant;

(c) an oil-soluble stabilizer additive being a polyol or polyol anhydride partial ester of a $C_{18}$–$C_{22}$ unsaturated fatty acid in an amount effective to reduce the tendency of said lubricating oil compositions to form sediment, and (d) a metal containing additive being a normal or basic metal phenate, sulfurized phenate or sulfonate in an amount of from 2 to 5 weight percent or a zinc dialkyldithiophosphate in an amount of from about 1 to 3 weight percent.

2. The composition of claim 1 wherein said (a) component is a dimer acid ester of an unsaturated fatty acid having from about 16 to 22 carbon atoms between the carboxylic acid groups of said dimer acid.

3. The composition of claim 1 wherein there is present 0.05 to 0.5 percent by weight of said (a) component based on the total weight of the lubricating oil composition.

4. The composition of claim 1 wherein said (c) component is a mixture of glycerol mono- and di-esters of oleic acid.

5. The composition of claim 3 wherein said (c) component is a sorbitan partial ester of oleic acid.

6. The composition of claim 1 wherein the weight ratio in parts by weight of said (c) component to said (a) component is from 2 to 20 parts by weight of said (c) component per part by weight of said (a) component.

7. The composition of claim 6 wherein said ratio is 2 to 12 parts by weight of said (c) component per part by weight of said (a) component.

8. The composition of claim 1 wherein said (a) component is diethylene glycol ester of dimerized linoleic acid present in an amount from about 0.1 to 0.3 weight percent, based on the total weight of the composition.

9. The composition of claim 1 wherein said (b) component is polyisobutenyl succinimide with polyisobutenyl moiety having an $\overline{M}n$ of about 900 to 1,500.

10. The composition of claim 1 wherein there is present 0.5 to 5 percent by weight of said (b) component.

11. The composition of claim 1 wherein the lubricating oil base stock is a mineral paraffinic hydrocarbon oil having a viscosity of about 20 to 100 cS min. (100° F.) or blends thereof.

12. The composition of claim 1 wherein said (b) dispersant component is a polyisobutenyl succinic anhydride-polyalkyleneamine reaction product.

* * * * *